United States Patent [19]

Taquoi

[11] Patent Number: 4,615,453

[45] Date of Patent: Oct. 7, 1986

[54] TANK HAVING REINFORCING SUPPORT MEANS

[75] Inventor: Jean-Pierre Taquoi, Noisy le Grand, France

[73] Assignee: B.S.L. (Bignier Schmidt-Laurent), Ivry sur Seine, France

[21] Appl. No.: 761,404

[22] Filed: Aug. 1, 1985

[30] Foreign Application Priority Data

Aug. 1, 1984 [FR] France ..... 84 12204

[51] Int. Cl.[4] ..... B65D 7/14; B65D 7/44

[52] U.S. Cl. ..... 220/71; 220/1 B

[58] Field of Search ..... 220/1.5, 1 B, 5 A, 71

[56] References Cited

U.S. PATENT DOCUMENTS

| | | | |
|---|---|---|---|
| 3,730,384 | 5/1973 | Ramme | 220/71 |
| 4,412,626 | 11/1983 | Gerhard | 220/71 |
| 4,469,236 | 9/1984 | Marsault et al. | 220/71 |

FOREIGN PATENT DOCUMENTS

| | | |
|---|---|---|
| 2327936 | 5/1977 | France . |
| 1362461 | 8/1974 | United Kingdom . |
| 1468665 | 3/1977 | United Kingdom . |
| 2024166 | 1/1980 | United Kingdom . |

*Primary Examiner*—George T. Hall

*Attorney, Agent, or Firm*—Fleit, Jacobson, Cohn & Price

[57] ABSTRACT

A container comprises an elongate tank arranged between two end frames with which it is solid, the side wall of the tank being in abutment against the sides of the frames and welded to these sides. That the right side and left side of the container are each provided with a device for resisting longitudinal forces. This device comprises two hoop portions welded on the surface of the side wall of the tank and braced by at least one brace applied against the wall of the tank and fixed to this wall in a manner longitudinally solid with it. These two hoops are each connected via an oblique profile to the nearest lower corner of the nearest frame.

18 Claims, 4 Drawing Figures

TANK HAVING REINFORCING SUPPORT MEANS

The present invention relates to a container.

It is applied to containers comprising, in a manner known in itself, an elongate tank, arranged between two end frames with which it is rigid, the end wall of the tank being, at each end, abutted directly or indirectly against the sides of the frames.

Such a container being intended to be transported, must be capable of resisting, without excessive deformations, longitudinal forces which are produced during braking or acceleration and an object of the invention is to equip the container with means capable of insuring this resistance, for as small an increase as possible in the tare of the container.

Another object of the invention is to arrange that the container can be gripped by clamps.

According to the invention, the right side and left side of the container are each provided with a device for resisting longitudinal forces which comprises two hoop portions welded on to the side wall of the tank and braced by at least one brace applied agains the wall of the tank and fixed to this wall in a manner so as to be longitudinally solid with it, these hoops each being connected by an oblique section to the nearest lower corner of the frame.

One thus obtains various advantages, particularly the fact that the forces introduced to the corners of the frames are transmitted to the body of the tank and return directly to the frames by the connections at the end of the tank to the frames, which is not the case with known containers, for example the containers described in the publications GB No. 2 024 166, GB No. 1 362 461, GB No. 1 468 665 and FR No. 2 327 936.

There will be described below an embodiment of the invention, with reference to the Figures of the accompanying drawing, the figures in the description will show other features of the invention.

Figures 1, 2, 3, 4:
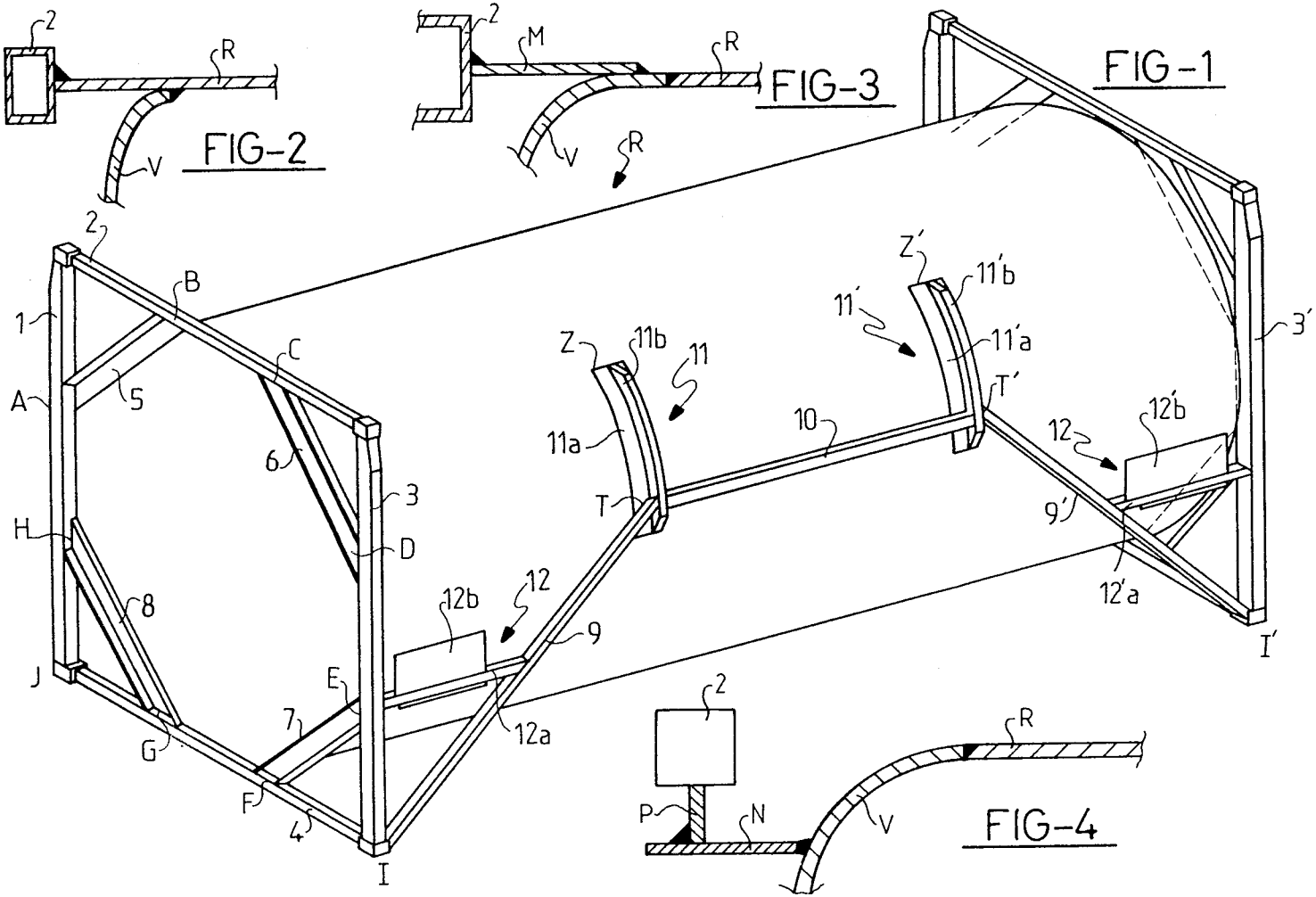
FIG. 1 is a perspective diagram of an embodiment.
FIGS. 2 to 4 are diagrams explaining the end structure of various containers to which the invention is applied.

The container shown in FIG. 1 comprises a cylindrical tank R with a thin wall (thickness between 2.5 and 5 mm) situated between two end bodies Z,Z' in a known manner.

The cylindrical wall of the tank is in abutment at each end against a hexagon ABCDEFGH formed by the sides 1,2,3 and 4 of the frame and of which the other sides AB,CD,EF and GH are constituted by diagonals 5,6,7 and 8 which connect pairs of the sides of the frame. The sides of the frame are, for example, consituted by square or rectangular sections and the diagonals are constituted by angle or channel sections. The end of the cylindrical wall of the tank R is welded to the sides of the hexagon.

According to the invention, the right side of the container (which is visible in the Figure) is provided with a resisting device which comprises two ring portions 11,11' welded onto the side wall of the tank and braced by a longitudinal brace 10 applied against the side wall of the tank and welded to it along its length, the hope 11(11') being each connected by an oblique section 9(9') to the nearest lower corner I(I') of the nearest frame.

Preferably, each ring portion 11,11' is extended upwards by an angle between $\pi/6$ and $\pi/4$ radians from a position situated above the horizontal median plane of the tank.

The oblique sections 9,9' abutting on the hoops 11,11' at points T,T' are substantially in the same vertical plane as the upper ends Z,Z' of the hoops.

As a result, the oblique sections 9,9' are approximately in a vertical plane tangent to the tank.

The longitudinal distance between the two hoops 11,11' is between 1/10 and ½ of the length of the tank.

Each of the sections 9,9' which connects a lower corner of a frame to a hoop makes, with the vertical, an angle of between 55° and 76°.

The section 9,9' which connects a lower corner I,I' of a frame to a hoop 11,11', is welded at this corner and is fixed to the hoop by welding or bolting.

The hoop 11,11' comprises a flange 11*a*,11*a'* applied against the side wall of the tank and a ring portion 11*b*,11*b'* which extends in a plane transverse to the tank.

The section 10 which connects the hoops between themselves abuts on the hoops in positions substantially oposite the points T,T' where the sections 9,9' abut which connect the hoops 11,11' to the corners of the frames.

Analogous arrangements are used on the other side of the tank for connecting the two other lower corners J and J', this latter not being shown in the Figure.

The container thus equipped suitably resists the longitudinal forces and the weight of the triangulations which connect on the one hand, corners I and I', and on the other J and J' in the region of half the weight of conventional devices which have longerons directly connecting the corners of the frames.

According to another feature of the invention, the section 9,9' is connected to the nearest upright 3,3' of the nearest frame by a structure 12,12', which permits the gripping of the container by clamps. This structure is constituted by for example a connecting section 12*a*,12*a'* which carries a protection plate 12*b*,12*b'*.

It should be noted that the devices 12,12' ensure a certain lateral protection of the tank.

The walls which close the container at its ends are not shown in the Figures: these walls are normally set back from the end planes of the side wall of the container.

In the embodiment which has been described by way of example, the side wall of the tank R is in abutment on the frames, which has been shown schematically in FIG. 2 where has also been shown a part of the wall V which closes the tank at its end.

When hot products are being transported, the sections 9 do not extend to the same extent as the wall of the tank and as this wall is in abutment against the frame, it produces a significant stress in the section 9 and its connections at T and I.

The situation is relieved when the abutment of the tank on the frame is obtained by the intermediary of a transverse ring which extends the side wall of the tank as far as the frame.

In an embodiment (FIG. 3) this ring M is in abutment against the frame and welded to it and is welded to the closing wall V of the end of the tank.

In another preferred embodiment (FIG. 4) this ring N crosses a transverse plate P which forms part of the end frame, the ring being welded to this plate and to the closing wall V of the end of the tank.

A certain flexibility which relieves the section 9 is thus conferred on the mounting.

The embodiment of FIG. 4 also has the following advantage: in the embodiments of FIGS. 2 and 3, it is necessary to mount the pieces 9 last and to adjust them; in the embodiment of FIG. 4, the adjustment is made in adjusting the position of the ring N on the plate P, it is not necessary to adjust the sections 9 which can be preassembled to the frame.

Applications of the invention are not limited to these types of tank which are known in themselves.

I claim:

1. A container comprising:

an elongate tank;

two end frames between which said tank is arranged and with which it is solid, the side wall of said tank being in abutment against the sides of said frames and welded to these sides;

a device provided respectively at the right side and the left side of the container for resisting longitudinal forces; and said device comprising:

two hoop portions welded on to the side wall of said tank, at least one brace bracing said hoop portions and applied against the wall of said tank and fixed to this wall in a manner to be longitudinally solid with it, and a respective oblique section connecting each hoop to the nearest lower corner of said nearest frame.

2. A container according to claim 1, wherein said brace and said oblique sections are approximately in a vertical plane tangent to said tank.

3. A container according to claim 1, wherein each said hoop portion is extended upwards through an angle of between $\pi/6$ and $\pi/4$ radian from a position situated above a horizontal median plane of said tank.

4. A container according to claim 1, wherein said oblique sections abut on said hoops at points which are substantially in the same vertical plane as the upper ends of said hoops.

5. A container according to claim 1, wherein the longitudinal distance between said two hoops is between 1/10th and $\frac{1}{2}$ of the length of said tank.

6. A container according to claim 1, wherein each of said oblique sections which connects a lower corner of a said frame to said hoop makes, with the vertical, an angle between 55° and 76°.

7. A container according to claim 1, wherein each said oblique section which connects a lower corner of a said frame to a said hoop is welded at this corner and is fixed to said hoop by soldering or bolting.

8. A container according to claim 1, wherein each said hoop comprises a flange applied against the side wall of said tank and a ring portion which extends in a plane transverse to said tank.

9. A container according to claim 1, wherein said two hoops are braced by said brace which is welded longitudinally against the side wall of said tank, said brace abutting on said hoops at positions substantially opposite the points where said oblique sections abut and which connect said hoops to the corners of said frames.

10. A container according to claim 1, wherein each said oblique section which connects a lower nearest corner of the nearest frame is connected to an upright of the frame which abuts this corner by a structure which permits gripping of said container by clamps.

11. A container according to claim 1, wherein said structure comprises a connection section which carries a protection plate.

12. A container according to claim 1, wherein said sides of said frame are connected by diagonals and the end or the side wall of said tank is also applied against said diagonals and welded to them.

13. A container according to claim 1, wherein the side wall of said tank has a thickness of between 2.5 and 5 mm.

14. A container claim 1, wherein the side wall of said tank is in abutment against the sides of said frame.

15. A container according to claim 14, wherein the side wall of said tank is welded against the sides of said frame.

16. A container according to claim 1, wherein said tank is in abutment on said end frame via the intermediary of a transverse ring.

17. A container according to claim 16, wherein said ring is a ring which is in abutment against said frame and is welded to it and is welded to a closing wall of said tank.

18. A container according to claim 16, wherein said ring is a ring which traverses a transverse plate which forms part of said frame, said ring being welded to said plate and to said closing wall of the end of said tank.

* * * * *